US006572386B1

(12) United States Patent
Howell et al.

(10) Patent No.: US 6,572,386 B1
(45) Date of Patent: Jun. 3, 2003

(54) SOCKET HAVING LOW WIPING TERMINALS

(75) Inventors: David Gregory Howell, Gilbert, AZ (US); Hao-Yun Mar, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/086,300

(22) Filed: Feb. 28, 2002

(51) Int. Cl.[7] ..... H01R 12/22
(52) U.S. Cl. ..... 439/66
(58) Field of Search ..... 439/66, 700, 246

(56) References Cited

U.S. PATENT DOCUMENTS 4,773,877 A * 9/1988 Kruger et al. ..... 439/482
4,778,404 A * 10/1988 Pass ..... 439/387
5,167,512 A * 12/1992 Walkup ..... 28/100
5,427,535 A * 6/1995 Sinclair ..... 439/66
5,573,435 A * 11/1996 Grabbe et al. ..... 439/862
5,772,449 A * 6/1998 Feldmeier et al. ..... 439/66
5,957,703 A * 9/1999 Arai et al. ..... 439/66
6,062,871 A * 5/2000 Arai et al. ..... 439/66
6,083,059 A * 7/2000 Kuan ..... 439/862

* cited by examiner

*Primary Examiner*—Gary R Paumen
*Assistant Examiner*—James R. Harvey
(74) *Attorney, Agent, or Firm*—Wei Te Chung

(57) ABSTRACT

A socket includes a housing and a plurality of terminals received in the housing. Each terminal includes a securing portion inserted in the housing, a mating portion and a spring portion connected between the securing portion and the mating portion. When the socket interconnects with first and second electronic devices, the spring portion is resiliently deformed to provide resilient force to the mating portion and the mating portion therefore engages with the second electronic device with minimized wiping relative to the second electronic device.

1 Claim, 3 Drawing Sheets

SOCKET HAVING LOW WIPING TERMINALS

BACKGROUND OF THE INVENTION

1. Field of the Invention

The present invention relates to sockets, and particularly to a land grid array (LGA) socket having low wiping terminals.

2. Prior Art

Electrical connectors are widely used in electronic devices for readily interconnecting to different electronic devices. Typically, an electrical connector includes a plurality of terminals for connecting a complementary connector and/or for being mounted on an electronic device, and a dielectric housing receiving the terminals therein. Nowadays, electrical signal transmissions tend to be high speed and high frequency, which requires highly secure connection between the terminals and complementary components.

FIG. 3 shows a conventional terminal 3 for a LGA socket. The terminal 3 includes a mating portion 5 for engaging with a pad of an electronic device, a soldering portion 7 for being soldered to a printed circuit board (PCB) and a connecting portion 9 connected between the mating portion 5 and the soldering portion 7.

However, when the terminal 3 engages with the pad, the mating portion 5 rotates about the junction of the mating portion 5 and the connecting portion 9. Therefore, the mating portion 5 wipes along the pad, and unable to contact with the pad steadily, which adversely affects the electrical connection between the terminal 3 and the pad.

SUMMARY OF THE INVENTION

Accordingly, an object of the present invention is to provide a socket having low wiping terminals for securely connecting with a complementary device.

To achieve the above-mentioned object, a socket in accordance with the present invention includes a housing and a plurality of terminals received in the housing. Each terminal includes a securing portion inserted in the housing, a mating portion and a spring portion connected between the securing portion and the mating portion. When the socket interconnects with first and second electronic devices, the spring portion is resiliently deformed to provide resilient force to the mating portion and the mating portion therefore engages with the second electronic device with minimized wiping relative to the second electronic device.

Other objects, advantages and novel features of the present invention will be drawn from the following detailed description of a preferred embodiment of the present invention with attached drawings, in which:

DETAILED DESCRIPTION OF THE PREFERRED EMBODIMENT

Figure 1:
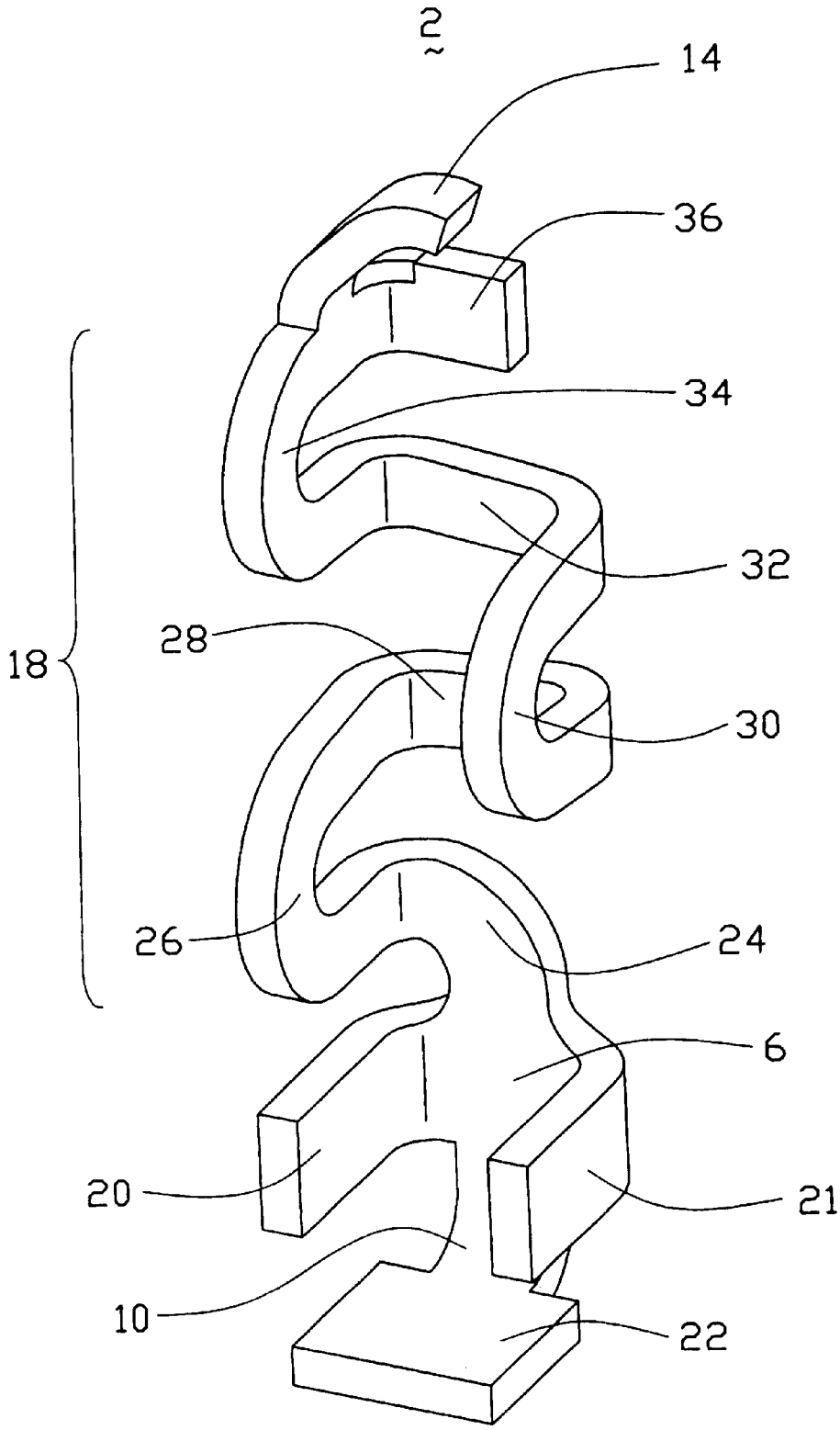
FIG. 1 is a perspective view of a terminal for LGA socket in accordance with the present invention.
Figure 2:
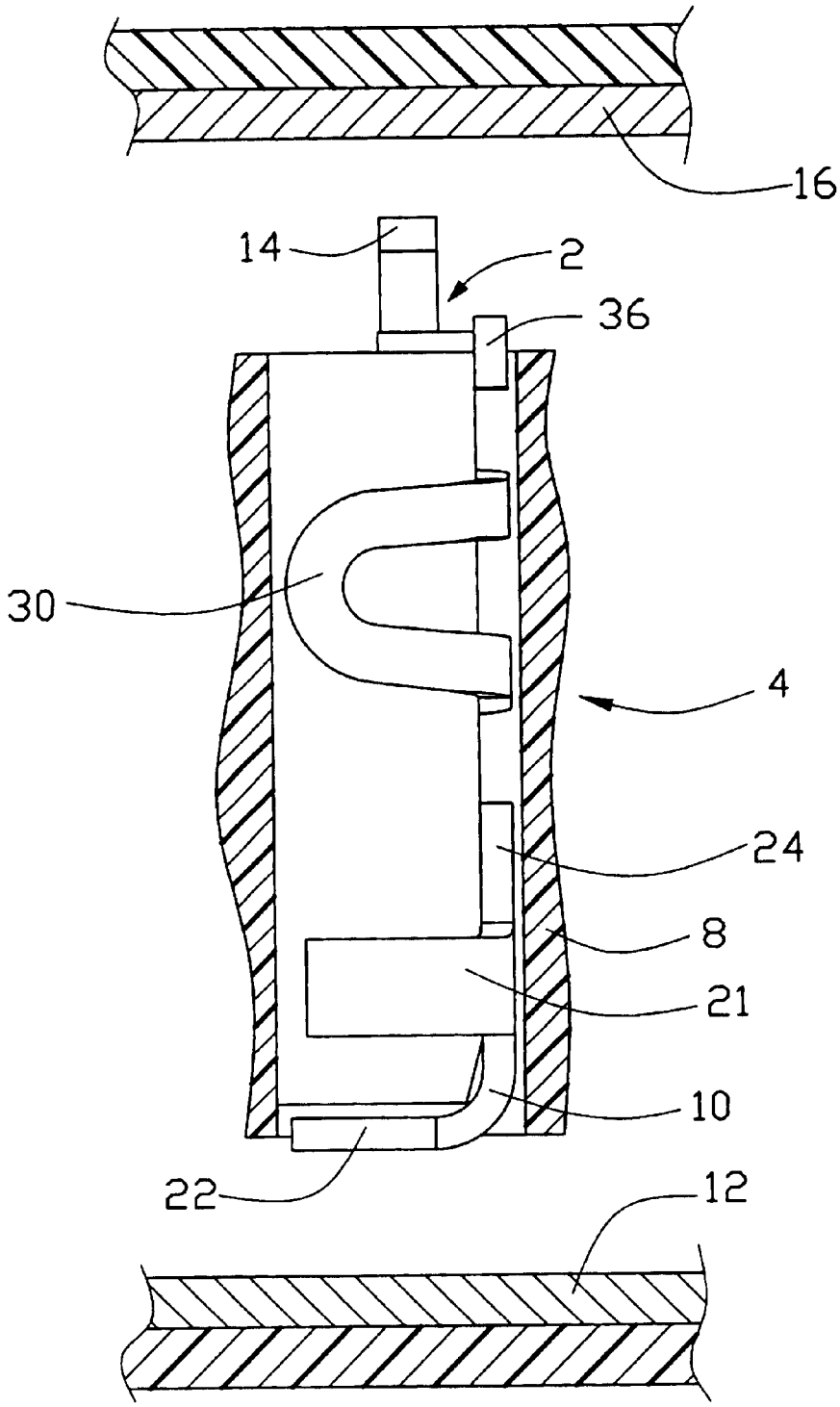
FIG. 2 is a schematic cross-sectional view of a socket with the terminal of FIG. 1 to be connected between two electronic devices.
Figure 3:
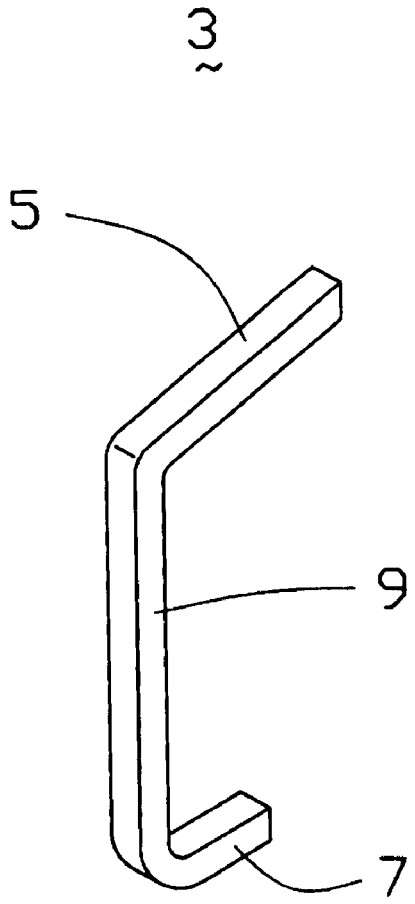
FIG. 3 (PRIOR ART)
FIG. 3 is a perspective view of a conventional terminal.

Referring to FIGS. 1 and 2, a terminal 2 of a LGA socket 4 in accordance with the present invention includes a securing portion 6 inserted into a passageway of a housing 8 of the LGA socket 4, a soldering portion 10 extending from the securing portion 6 for being soldered to a first electronic device 12, a mating portion 14 for engaging with a second electronic device 16, and a spring portion 18 connected between the mating portion 14 and the securing portion 6. Opposite first and second securing arms 20, 21 horizontally extend from two sides of the securing portion 6 and are generally perpendicular to the securing section 6. The soldering portion 10 has a horizontally extending rectangular plate 22. The mating portion 14 is generally arcuate and locating at the end of the terminal 2. Opposite the mating portion 14, the rectangular plate 22 is locating at the other end of the terminal 2.

The spring portion 18 includes a transition section 24 extending upwardly from the securing portion 6 and toward to the first securing arms 20. A first U-shaped section 26 extends from the transition section 24 and is generally coplanar with the first securing arm 20. A first connecting section 28 horizontally extends from the first U-shaped section 26 and is generally coplanar with the transition section 24. A second U-shaped section 30 extends from the first connecting section 28 and is coplanar with the second securing arm 21. A second connecting section 32 horizontally extends from the second U-shaped section 30 and is generally coplanar with the transition section 24. A third U-shaped section 34 extends from the second connecting section 32 and is generally coplanar with the first securing arm 20. A free section 36 horizontally extends from the third U-shaped section 34 and is generally coplanar with the transition section 24. The mating portion 14 extends from the third U-shaped section 34 adjacent the junction between the third U-shaped section 34 and the free section 36. With these structures, the spring portion 18 has enough elasticity, Which secures the terminal to engage with the first electronic device 12 and second electronic device 16 steadily.

When the socket 4 interconnects between the first and second electronic devices 12, 16, the soldering portion 10 of the terminal 2 is soldered to the first electronic device 12. The mating portion 14 of the terminal 2 engages with the second electronic device 16 with minimized deformation thereof, since the spring portion 18 is easier to be resiliently deformed than the mating portion 14. The spring portion 18 provides resilient force to assure stable connection between the mating portion 14 and the second electronic device 16. Thus, the mating portion 14 has low or minimized wiping relative to the second electronic device 16 thereby achieving connection between the socket 4 and the second electronic device 16.

It is understood that the invention may be embodied in other forms without departing from the spirit thereof. Thus, the present example and embodiment is to be considered in all respects as illustrative and not restrictive, and the invention is not to be limited to the details given herein.

What is claimed is:

1. A socket comprising:

a housing; and a plurality of terminals received in the housing, each terminal comprising a securing portion inserted in the housing, a soldering portion extending from the securing portion for being soldered to a first electronic device, a mating portion, and a spring portion connected between the securing portion and the mating portion, the spring portion comprising a plurality of U-shaped sections formed on opposite sides of the securing portion, a transition section extending between one U-shaped section and the securing portion, and a plurality of connecting sections, each connecting section extending between two of the U-shaped sections and being substantially perpendicular to the U-shaped sections; wherein when the terminal interconnects with the first and second electronic devices, the U-shaped sections of the spring portion are resiliently deformed to provide a resilient force to the mating portion and the mating portion therefore engages with the second electronic device with minimized wiping relative to the second electronic device;

wherein opposite first and second securing arms horizontally extend from two sides of the securing portion and are substantially perpendicular to the securing portion;

wherein the connecting sections are substantially coplanar with the securing portion;

wherein the transition portion is substantially perpendicular to the U-shaped portion and substantially coplanar with the securing portion, wherein a free section extends from another U-shaped section and is substantially perpendicular to the U-shaped section, and wherein the free section is substantially coplanar with the securing section and the connecting sections, wherein the mating portion extends from the another U-shaped section and adjacent the junction between the U-shaped section and the free section.

* * * * *